US005469795A

United States Patent [19]

Moorman

[11] Patent Number: 5,469,795

[45] Date of Patent: Nov. 28, 1995

[54] PALLET CONSTRUCTED OF SHEET MATERIAL

[75] Inventor: Stephen E. Moorman, Bowling Green, Ohio

[73] Assignee: Georgia-Pacific Corporation, Atlanta, Ga.

[21] Appl. No.: 197,826

[22] Filed: Feb. 17, 1994

Related U.S. Application Data

[62] Division of Ser. No. 772,661, Oct. 7, 1991, Pat. No. 5,337,679.

[51] Int. Cl.[6] ..... B65D 19/00

[52] U.S. Cl. ..... 108/51.3

[58] Field of Search ..... 108/51.1, 51.3, 108/56.1, 56.3

[56] References Cited

U.S. PATENT DOCUMENTS

| | | |
|---|---|---|
| 2,444,183 | 6/1948 | Cahners . |
| 2,494,730 | 1/1950 | Thursby . |
| 2,576,715 | 11/1951 | Farrell . |
| 2,996,276 | 8/1961 | Sorensen et al. . |
| 3,012,747 | 12/1961 | Greene . |
| 3,026,015 | 3/1962 | Severn . |
| 3,026,078 | 3/1962 | Simkins . |
| 3,113,532 | 12/1963 | White . |
| 3,131,656 | 5/1964 | Houle . |
| 3,302,593 | 2/1967 | Roberts . |
| 3,434,435 | 3/1969 | Achermann et al. . |
| 3,464,371 | 9/1969 | Gifford . |
| 3,477,395 | 11/1969 | Brown et al. . |
| 3,587,479 | 6/1971 | Geschwender . |
| 3,659,534 | 5/1972 | Childs . |
| 3,666,165 | 5/1972 | Osborne et al. . |
| 3,683,822 | 8/1972 | Roberts et al. . |
| 3,911,834 | 10/1975 | Quaintance . |
| 3,952,672 | 4/1976 | Gordon et al. . |
| 4,185,565 | 1/1980 | Nymoen . |
| 4,714,026 | 12/1987 | Yamaguchi et al. . |
| 4,841,879 | 6/1989 | Ferguson . |
| 4,863,024 | 9/1989 | Booth . |
| 4,867,074 | 9/1989 | Quasnick . |
| 4,875,419 | 10/1989 | Helton et al. . |
| 4,936,229 | 6/1990 | Parnell . |
| 4,966,084 | 10/1990 | Motomaru . |
| 4,979,446 | 12/1990 | Winebarger . |
| 4,986,418 | 1/1991 | Gwathmey . |
| 5,076,176 | 12/1991 | Clasen . |
| 5,176,090 | 1/1993 | Roberts et al. . |
| 5,184,558 | 2/1993 | Wozniacki . |

FOREIGN PATENT DOCUMENTS

| | | |
|---|---|---|
| 996516 | 6/1965 | United Kingdom . |
| 1106880 | 3/1968 | United Kingdom . |
| 1498808 | 1/1978 | United Kingdom . |

*Primary Examiner*—Jose V. Chen
*Attorney, Agent, or Firm*—Banner & Allegretti, Ltd.

[57] ABSTRACT

A pallet is formed of sheet material such as corrugated paperboard and has as its primary components a platform or upper deck upon which materials may be placed and a plurality of runners depending from the platform for elevating the platform and providing load-bearing strength. Only two types of blanks of sheet material are required to assemble a completed pallet. A first blank forms an upper deck or platform layer as well as a first set of runners formed of adjacent panels secured together in face-to-face relation. A second blank forms a second set of runners formed of adjacent panels secured together in face-to-face relation and, in one preferred embodiment, additional underlayers of the platform.

11 Claims, 5 Drawing Sheets

PALLET CONSTRUCTED OF SHEET MATERIAL

This application is a division of application Ser. No. 07/772,661 filed Oct. 7, 1991, now U.S. Pat. No. 5,337,679.

BACKGROUND OF THE INVENTION

Pallets and platforms for bulk storage and transportation of materials constitute a multi-billion dollar industry. Their use is pervasive in a myriad of commercial applications, e.g., for the storage of raw and finished products in manufacturing facilities, for the transportation of finished products and materials from manufacturing facilities to distributors and retail outlets, and for storing finished materials in warehousing and retail facilities. Pallets are extremely useful for storing and transporting material since they provide an elevated support platform which protects the stored goods from spilled materials, etc. and allow conventional equipment such as a forklift to readily move large quantities of materials stored on the pallet.

Pallets are typically constructed of wood slats. Such pallets are suitable for a number of applications, especially where very heavy loads are encountered. However, wood pallets are heavy and not easily disposable or recyclable. Certain industries, such as the food industry, are extremely interested in replacing wood pallets with light weight and easily disposable/recyclable pallets, so long as such pallets can meet certain strength and durability requirements.

As an alternative to wooden pallets, pallets have been constructed of sheet material such as corrugated board material, e.g., corrugated paperboard and the like. Existing pallets constructed of sheet material have met with only limited success due to the drawbacks of limited strength and durability. Furthermore, only limited cost savings have been achieved in existing sheet material pallets due to the complexity of manufacture and assembly arising out of the multiple blanks and other pieces required to make a completed pallet. The following patents exemplify existing pallets constructed of sheet material.

Yamaguchi et al., U.S. Pat. No. 4,714,026, discloses a pallet including a deck board made from laminated corrugated fiberboard. Each of the legs is formed by a square-tubular frame made of corrugated fiberboard in which a pad or pads of plastic resin is/are inserted.

Nymoen, U.S. Pat. No. 4,185,565, discloses a two-piece corrugated pallet formed from a base member and a platform member of corrugated board material. The base piece is formed by three parallel spaced channel sections connected by platform reinforcing portions. The platform member is secured to the base piece.

Winebarger, U.S. Pat. No. 4,979,446, discloses a corrugated pallet formed from interconnected base and deck members constructed from creased and scored rectangular blanks to comprise a solid core of adjacent vertically oriented panels surrounded by an outer covering of perimetric horizontally and vertically running panels. Once the base members are assembled using a U-shaped slot arrangement, a separate deck board is attached thereto.

Osborne et al., U.S. Pat. No. 3,666,165, discloses a pallet having four-way fork entry capability. Tubular members are inserted into a folded sheet of corrugated material to form the runners. A separate panel is required to form the deck.

Quaintance, U.S. Pat. No. 3,911,834, discloses a pallet made of foldable material having four-way fork entry capability. A plurality of runners are formed integrally from a blank forming the deck and take the form of hollow elongated channels.

There is a need for a pallet constructed of sheet material, such as corrugated paperboard and the like, that assembles with efficiency, meets customer's expectations for strength, stability and ease of use, and that is easily disposable or recyclable.

SUMMARY OF THE INVENTION

The primary object of the present invention is to provide a pallet constructed of sheet material having the advantages over a wood pallet of easy disposability/recycleability, lower cost and lower weight, while at the same time providing a pallet having sufficient strength and stability for use in a wide range of applications.

It is a further object of the present invention to provide a pallet constructed of sheet material having advantages over known pallets formed of sheet material with respect to strength, efficiency of manufacture and assembly, and durability.

It is another object of the present invention to provide a pallet construction that is suitable for use in specialty applications such as for display purposes, e.g., in a warehouse-type retail store.

It is a yet further objective of the present invention to provide sheet material blanks which can be easily manufactured utilizing conventional paperboard product manufacturing equipment, and then easily assembled to form a completed pallet.

It is an additional object to provide a pallet design which minimizes the number of blanks necessary to construct the completed pallet.

These and other objects are achieved in accordance with a first aspect of the present invention by a pallet formed of sheet material for storing and transporting material thereon, wherein a platform provides a substantially planar support surface upon which materials may be placed and a plurality of intersecting runners are attached to the platform on an underside thereof for supporting the platform in an elevated position and providing load-bearing strength. Each of the intersecting runners is formed from a plurality of adjacent panels of the sheet material. Each panel has planar surfaces lying substantially perpendicular to the support surface and being secured together in face-to-face relation in a direction substantially parallel to the support surface. At least a portion of the platform and at least one of the panels of the intersecting runners are integrally formed of single piece of sheet material.

In another aspect, the present invention provides a pallet for storing and transporting material thereon comprising at least one first sheet member having a first panel forming at least a portion of an upper deck of the pallet and a plurality of sets of second panels attached to each other and the first panel by hinge means for folding the second panels within each set against one another in an accordion-like fashion to form a plurality of spaced runners depending from the upper deck and extending in a first direction.

In a further aspect, the present invention provides a pallet for storing and transporting material thereon comprising two first sheet members which cooperate to form an upper deck top layer and a first set of spaced runners depending from the upper deck and extending in a first direction; and two second sheet members which cooperate to form at least one upper deck lower layer and a second set of spaced runners depending from the upper deck and extending in a second direction perpendicular to the first direction.

In a yet further aspect, the present invention provides a blank of sheet material for forming a pallet platform and a plurality of runners depending therefrom. The blank includes a platform-forming panel and a plurality of runner-forming panels hingedly attached to opposite edges of the platform-forming panel. The runner-forming panels include pairs of panels hingedly connected at adjacent edges thereof and a plurality of spaced-apart cut-outs extending across the adjacent edges for forming cross-runner receiving slots when the runner-forming panels are folded together in an accordion-like manner.

A still further aspect of the present invention provides a blank of sheet material for forming a plurality of layers of a pallet platform and a plurality of runners depending therefrom. The blank comprises a first platform layer forming panel and a second platform layer forming panel movably connected with the first platform layer panel through a plurality of series of runner-forming panels connected to each other and to the first and second platform layer forming panels along respective hinged edges thereof. When the runner-forming panels within a series are folded against each other in an accordion-like manner, the first and second platform layers at least partially overlap with each other to form multiple platform layers, and the runner-forming panels form a plurality of runners depending therefrom.

In another aspect, the invention provides a set of blanks of sheet material for forming a pallet comprosing blank as above-described.

Other objects and features of the present invention will become apparent and fully understood from the following detailed description of the preferred embodiments, taken in connection with the drawing figures.

BRIEF DESCRIPTION OF THE DRAWINGS

FIG. 8 further includes a telescopic close-up view of one possible hinge arrangement used to connect adjacent panels of the blanks.

DETAILED DESCRIPTION OF THE PREFERRED EMBODIMENTS

Figure 1:
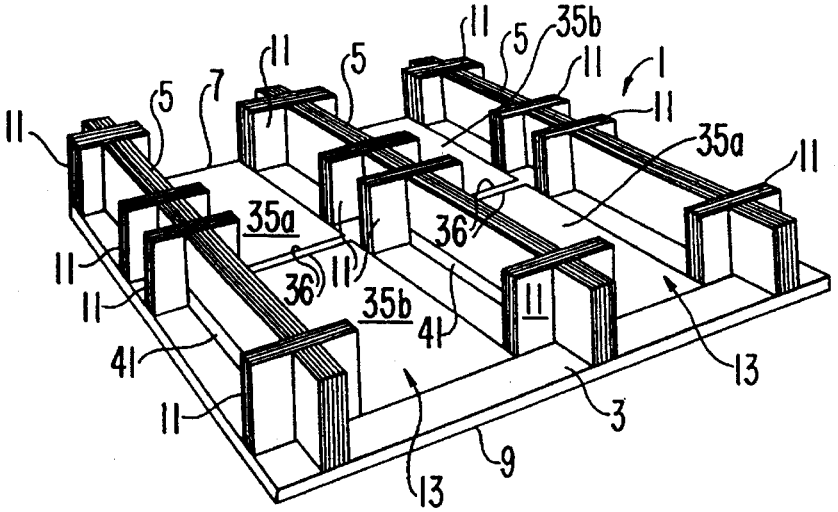
FIG. 1 is a perspective view illustrating in completed form the bottom surface of a pallet in accordance with a first embodiment of the present invention.
Figure 2:
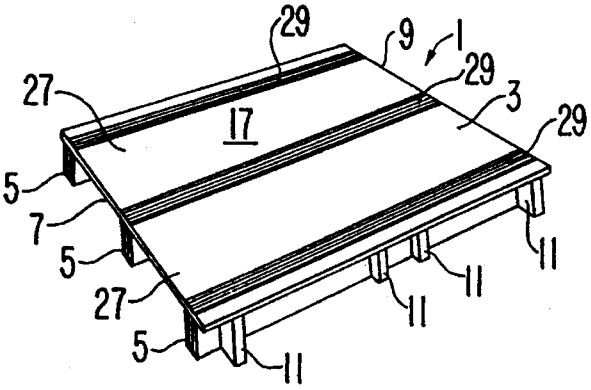
FIG. 2 is a perspective view illustrating a top surface of the completed pallet of FIG. 1.
Figure 4:
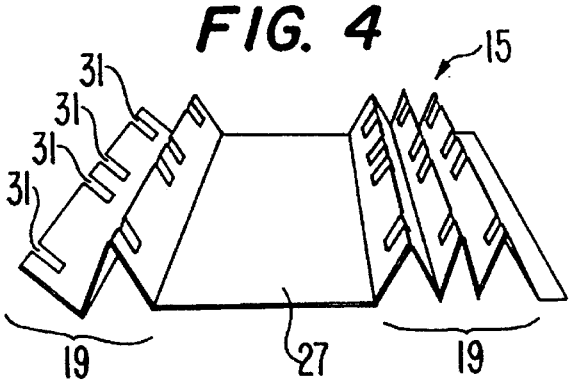
FIG. 4 is a perspective view of a first blank for constructing the pallet of FIGS. 1 and 2, shown in a semi-folded condition.
Figure 5:
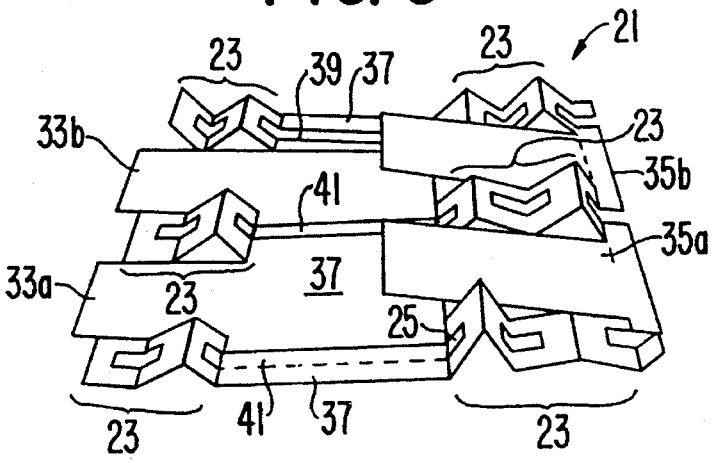
FIG. 5 is a perspective view of a second blank used to form the pallet of FIGS. 1 and 2, shown in a semi-folded condition.

Referring first to FIGS. 1 and 2, illustrated is a completed pallet 1 of the present invention formed from a set of the semi-folded blanks 15 and 21 shown separately in FIGS. 4 and 5. These blanks are preferably formed of conventional corrugated container board, e.g., corrugated paper board, or synthetic corrugated material such as extruded low density polyethylene material. Additionally, solid fiber board may constitute a suitable material depending on the particular pallet application. Corrugated paperboard is generally preferred for its relatively low cost, high strength and disposability/recycleability.

Assembled pallet 1 comprises an upper platform or deck 3 and a plurality of intersecting runners depending therefrom for elevating the platform above the ground and providing load bearing (stacking) strength. The runners include a first set of runners 5 which extend in a first direction substantially the entire distance between opposite edges 7 and 9 of top panel 3. The plurality of runners further include a number of cross-runners 11 intersecting runners 5 at spaced locations therealong and extending in a second direction perpendicular to runners 5. Runners 11 are preferably abbreviated in size in order to provide passageways 13 for insertion of lifting equipment such as a lifting fork. In the illustrated embodiment, three spaced runners 5 and twelve spaced cross-runners 11 are shown. Obviously, the number of runners may be varied in accordance with the size and load requirements of the pallet.

Figure 8B:
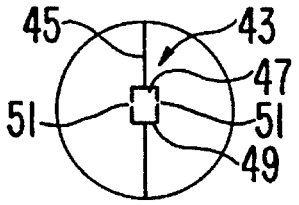
FIG. 8 is a plan view of the blank shown in FIG. 4, in a flat condition and also provided with cut-outs for forming lifting fork-insertion slots.
Figure 8A:
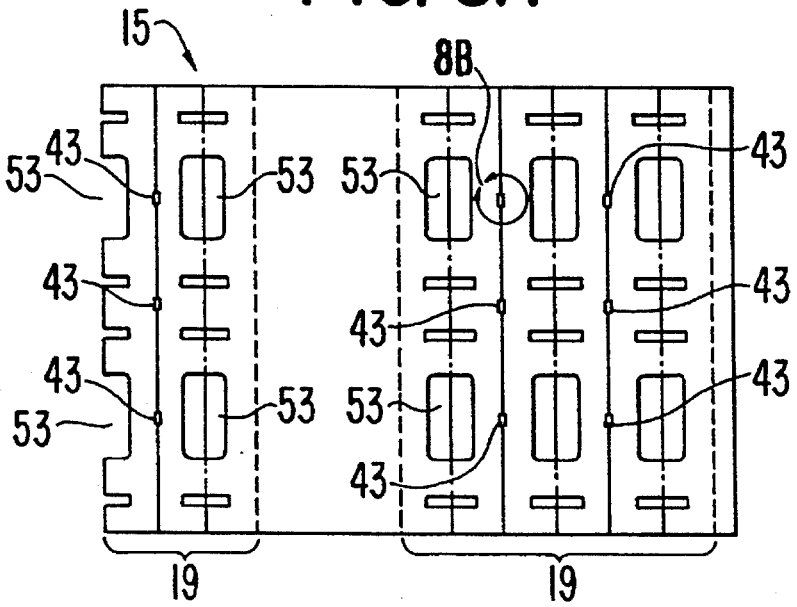

Although not illustrated in FIG. 1, four-sided liftfork entry capability can easily be accomplished by providing at appropriate spaced locations along runners 5 (between cross-runners 11) cut-out portions providing slots for fork insertion. Such slots are shown in the blank of FIG. 8 and described in further detail hereinbelow.

Figure 3:
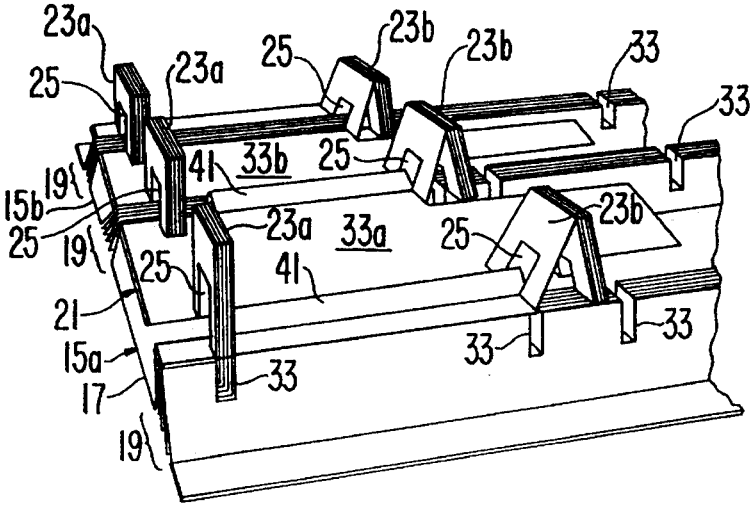
FIG. 3 is a partial perspective view illustrating the manner in which the blanks shown in FIGS. 1 and 3 are assembled to form the pallet shown in FIGS. 1 and 2.
Figure 6:
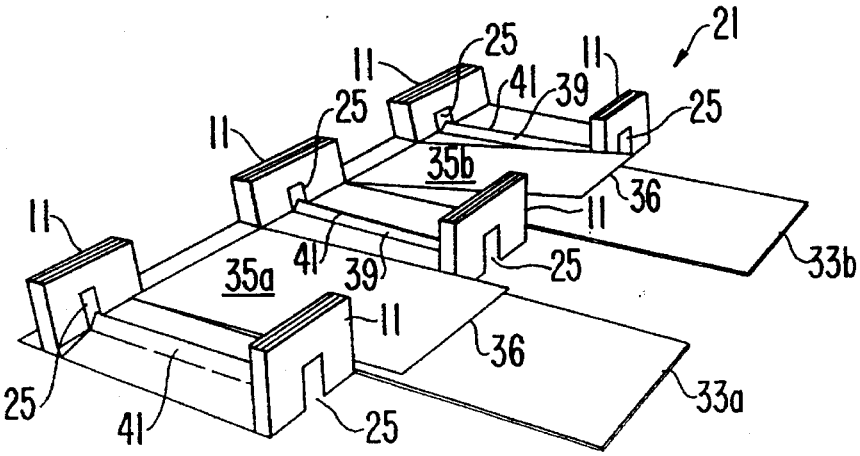
FIG. 6 is a perspective view of the blank shown in FIG. 5, shown in a fully folded position ready for assembly with a pair of blank of the type as shown in FIG. 1.

Top panel 3 comprises multiple layers of the sheet material. Referring to FIG. 3, it is seen that a top layer of platform 3 is provided by the assembly of a first set of identical blanks **15*a*, 15*b*. In addition to providing a top layer 17 of the platform, blanks 15 have adjacent panels 19 which, when folded together in an accordion-like manner, form elongated runners 5. A second set of two blanks 21 (only one seen in FIG. 3) comprise overlapping panels which, when the blanks are folded as seen in FIG. 6 and assembled with folded blanks 15*a*, 15*b* provide multiple additional layers to the platform 3. Each blank 21 also includes a plurality of series of adjacent cross-runner forming panels 23 which, when folded against each other in an accordion-like manner, form cross-runners 11. In the first preferred embodiment, the completed pallet is thus constructed of a total of four corrugated pieces, two identical blanks 15 used to form top layer 17 of platform 3 and elongated runners 5, and two identical blanks 21 used to form additional underlayers of platform 3 as well as cross-runners 11**.

In the state shown in FIG. 3, two blanks **15*a* and 15*b* have been placed together in a side-by-side mirror image relation to form a completed upper deck or platform top layer 17**.

One set of panels 19 from each blank 15*a*, 15*b* cooperate to form the central one of runners 5 which defines a line of symmetry of the pallet. As best seen in FIG. 4, each blank 15 comprises a panel 27 forming a half-portion of upper deck top layer 17. Attached on the left side of panel 27, as viewed in FIG. 4, are three runner-forming panels 19 hingedly connected to each other and to panel 27. On an opposite side of panel 27 are provided twice as many (six) runner-forming panels 19. Thus, when two panels 15*a*, 15*b* are positioned together as shown in FIG. 3, a symmetrical form is created with each runner 5 being constituted by six panels 19 secured together in face-to-face relation.

Blanks 15*a*, 15*b* need not be provided separately. Depending upon the size requirements of the pallet and size capability of the blank forming equipment, respective pieces 15*a*, 15*b* could be formed integrally as a single piece.

Advantageously, the number of panels 19 forming each runner 5, and thus the thickness and strength of each runner 5, can be easily varied in accordance with the required load bearing strength of the pallet. The thickness of cross-runners 11 can be similarly varied.

As seen in FIG. 2, panels 27 of respective pieces 15*a*, 15*b* form the major part of the upper surface of platform 3. The upper surface also comprises elongated (linear) corrugated edge portions 29 of each runner 5.

Figure 7:
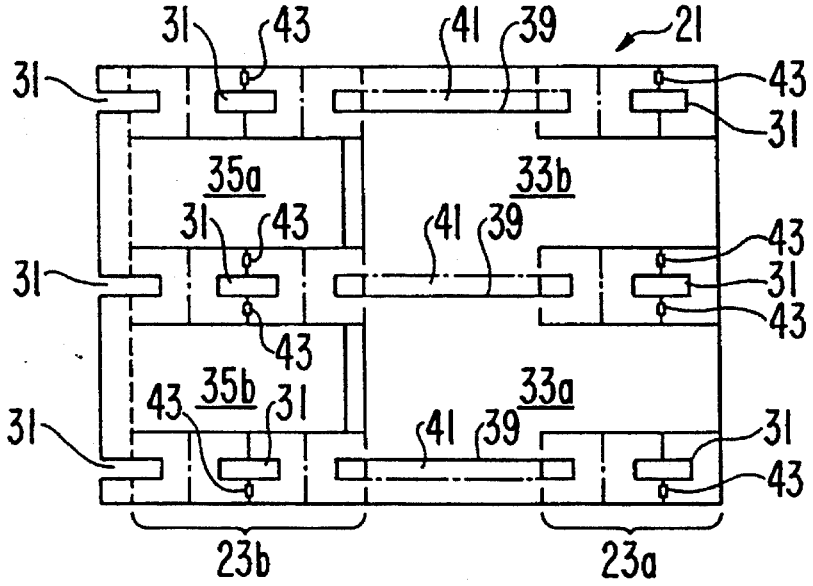
FIG. 7 is a plan view of the blank illustrated in FIG. 5, shown in a flat condition.

Shown in FIGS. 4 and 7 are cut-outs 31 in blank 15. Cut-outs 31 come together when runner-forming panels 19 are folded together to create a series of spaced slots 33 (FIG. 3) in each runner 5. Similarly, cut-outs 25 are provided in cross-runner forming panels 23 of blank 21, which come together to create a series of spaced slots in each cross-runner 11.

Slots 33 cooperate with the slots provided by cut-outs 25 such that runners 5 and cross-runners 11 securely engage with each other at points of intersection thereof. The provision of cross-runners 11 greatly enhances the stability of the pallet over designs having only a single set of parallel runners.

Only one piece 21 is shown in FIG. 3. However, as previously indicated, to form a completed pallet, two folded blanks 21 are secured adjacent to each other on folded and assembled blanks 15*a*, 15*b*. Two blanks 21 are placed in a side-by-side partially overlapping relationship to create a plurality of underlayers of platform 3 as well as cross-runners 11, as will be better understood from the following description of blank 21 in connection with FIGS. 5 and 6.

Blank 21 comprises platform layer forming panels 33*a*, 33*b*, and platform layer forming panels 35*a*, 35*b* moveably connected with platform layer panels 33*a*, 33*b* through a plurality (three in the illustrated embodiment) of series of cross-runner forming panels 23 which are connected to each other and to platform layer forming panels 33*a*, 33*b* and 35*a*, 35*b* along respective hinged edges thereof.

FIG. 6 illustrates blank 21 in its completely folded position wherein panels 23 are folded together in an accordion-like manner to form cross-runners 11. In this folded state, respective pairs of panels 33*a*, 33*b* and 35*a*, 35*b* assume a partially overlapped relationship. More specifically, in the folded condition, panels 35*a* and 35*b* reside on top of panels 33*a* and 33*b*, respectively, and are completely overlapped thereby. Panels 35*a*, 35*b* extend a short distance beyond rightmost cross-runners 11 as seen in FIG. 6. Panels 33*a*, 33*b* extend beyond the panels 35*a*, 35*b* for a substantial distance. Two blanks 21 are secured to folded and combined blanks 15*a*, 15*b* in an overlapped mirror-image relationship with each other such that end edges 36 of respective panels 35*a*, 35*b* of each blank 21 extend adjacent to each other between the closely spaced central cross-runners 11 (see FIG. 1). With the respective blanks 21 so positioned, respective panels 33*a*, 33*b* of each blank 21 overlap with each other for a substantial portion of the distance between opposite edges 7 and 9 of platform 3, and panels 35*a*, 35*b* are completely overlapped by panels 33*a*, 33*b*. In this manner, two folded and combined blanks 21 provide a plurality of underlayers serving to reinforce platform 3.

The corrugation direction (the direction in which the corrugation flutes extend) of panels 33*a*, 33*b*, 35*a*, 35*b* of piece 21 is preferably perpendicular to the corrugation direction of panels 27 of respective pieces 15*a*, 15*b* forming the upper layer 17 of the platform. As a result, a very rigid platform 3 is created by the lamination of multiple layers of corrugated materials having perpendicular corrugation directions. This design effectively compensates for the fact that corrugated material has a lesser resistance against bending and collapse along axes parallel to the extending direction of the corrugation flutes. Thus, enhanced strength characteristics of the pallet are achieved.

Referring to FIGS. 5 and 6, blank 21 has, adjacent to panels 33*a* and 33*b*, portions 37 extending between sets of aligned runner-forming panels 23. Each portion 37 has provided therein an elongated cut-out aligned with slot-forming cut-outs 25 provided in panels 23 for accommodating therein a respective one of runners 5 formed by folded and assembled blanks 15*a*, 15*b*. Provided adjacent to each elongated cut-out 39 is a flap 41 formed of sheet material cut along three edges from portion 37 to form cut-out 39. After the pallet pieces are assembled, each flap 41 is secured along a side face of each runner 5 by appropriate means of attachment, as described below.

Preferably, during assembly, adhesive is used to laminate contacting surfaces of each piece together. In particular, adhesive is preferably used to secure runners 5 and cross-runners 11 together at the points of intersection thereof. Also, other mating planar surfaces of the combined blanks 15 and 21 as well as the surface areas of each of runner-forming panels 19 and 23 may also be secured together by adhesive to thereby provide additional structural integrity to the pallet. Suitable adhesive compositions will be apparent to those skilled in the art, and will depend upon the chosen pallet material as well as other factors. Additionally, other known means may be utilized for securing the respective pieces together, separately or in combination with adhesives, including stitching and stapling.

Referring now to FIGS. 7 and 8, illustrated in a flat condition are the respective blanks 15 and 21 used to form the pallet shown in FIGS. 1 and 2. A significant advantage of the present invention is that a completed pallet may be formed from only two types of blanks as shown in these Figures. This greatly simplifies manufacture of the component blanks and assembly of the pallet pieces. Preferably, the blanks are scored and slit by forming dies. The pieces may also be constructed by other common fiberboard product manufacturing techniques.

FIGS. 7 and 8 show with added clarity the score lines, slit lines, and cut-out portions in the blanks 15 and 21 of the first preferred embodiment. Generally, interior solid lines indicate slits which extend all the way through the material. The remaining hatched and dotted lines indicate hinged connections between respective panels. These hinged edges may take the form of simple folds along score lines provided in the material. (A score line is simply a linear impression created on the sheet material forming a line of weakening upon which a fold can occur.) Other techniques may be utilized for facilitating the folding of the corrugated panels relative to each other, as described below.

Adjacent panels which are to be folded against each other may be attached by a simple notch-type hinge. In this arrangement, adjacent panels are separated by a slit line which is interrupted by short segments along the hinge line which remain uncut. These segments of material thus serve as hinge points for the respective panels.

A variation on a simple notch hinge is a hinge score. Hinge scores are depicted at 43 in FIGS. 7 and 8. A hinge score is formed by interrupting a cut line 45 between respective panels for a short segment 47, similar to a notch-type hinge. Additionally, perpendicular cuts 49 are provided on opposite sides of uncut segment 47, and a pair of score lines 51 are provided parallel to but displaced from cut line 45. This arrangement is advantageous for facilitating bidirectional folding of respective panels without material binding or excessive material weakening.

Another option for providing a hinged connection of adjacent panels is a slit-scoring arrangement wherein respective panels are separated by slits which extend only part-way through the material. In this arrangement, at least one uncut layer remains which may serve as a weakened hinge point.

Other suitable hinging techniques will be apparent to those skilled in the art.

The preferred hinging method will depend, in part, upon the equipment available for creating the blanks. If the available equipment does not easily allow for slit scoring from either side of the material, this technique may not be desirable for the following reason. Runner-forming panels 19 and 25 are preferably folded in an accordion-like manner. Thus, the directions of the folds will alternate from one panel edge to the next. If slit scoring is used, it is necessary to provide these slit scores from opposite sides of the material in order to allow for folding in the required directions without material binding. Notches have the advantage of bidirectional folding thus avoiding the need to provide cutting from opposite sides of the material. Depending on the available equipment, notches may or may not be easier to provide than slit score hinges. Hinge scores are not as simply provided as notch-type hinges. However, hinge scores better facilitate the bidirectional folding required of runner-forming panels 19 and 23 as compared with notches. Simple score lines are simple and inexpensive to provide. However, folding about a score line is generally not as easy as folding about hinge lines created utilizing the other methods.

It is preferable that the corrugation direction of each blank be perpendicular to the hinge lines of the respective panels. In this manner, greater structural integrity at the hinge points is maintained.

An optional feature illustrated in FIG. 8 is cut-away portions 53 extending across adjacent edges of runner-forming panels 19 for forming liftfork-receiving slots when runner-forming panels 19 are folded together. By providing such slots, the pallet is provided with four-sided forklift entry capability.

Adjacent runner-forming panels 19 and 23 are preferably hingedly connected to each other as described above. This arrangement greatly facilitates assembly of the completed pallet since fewer loose pieces are encountered. This arrangement is not, however, an essential feature of the present invention. One or more of adjacent panels 19 and 23 could be provided separate from each other and laminated together in face-to-face relation to form runners 5 and 11, respectively. In this way, runners of substantially the same stability and load bearing strength could be obtained, but without the aforementioned ease of assembly.

The use of vertically oriented adjacent panels of corrugated material for forming the pallet runners 5 and 11 facilitates pallet assembly and allows the thickness (and hence the strength) of the runners to be easily varied. This arrangement has an additional advantage. Namely, exposed corrugation flutes along the bottom edge surfaces of runners 5 and 11 may serve as convenient receptors for application of a moisture resistant composition. Such a moisture resistant composition is desirable in order to inhibit the migration of moisture/water from the floor surface to the pallet to thereby enhance the retention of pallet stacking strength and stability. Suitable coatings, which are widely known and commercially available, include wax based compositions, resin-type compositions and water soluble silicone based solutions. Application methods may include hot/cold roller coating, dipping and spraying.

Figure 9:
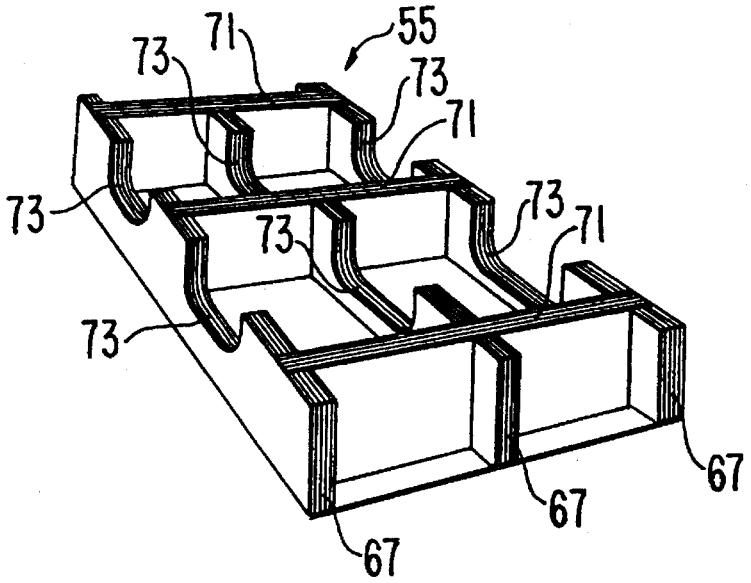
FIG. 9 is a perspective view of the bottom surface of a pallet in accordance with a second embodiment of the present invention.
Figure 10:
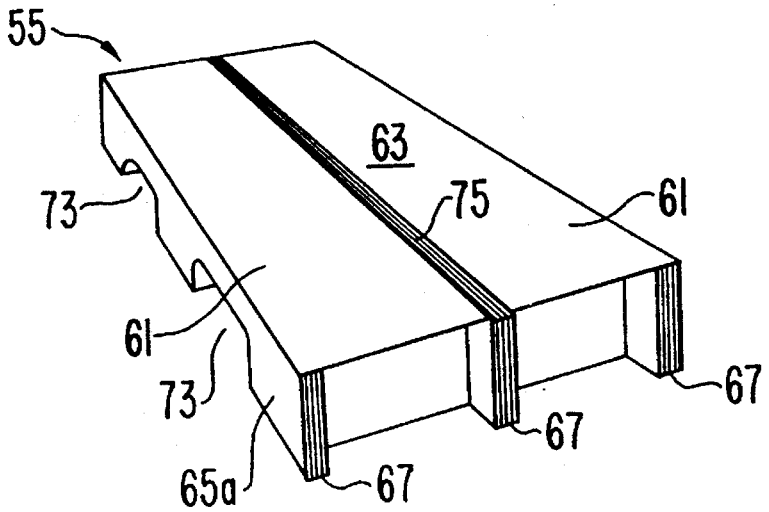
FIG. 10 is a perspective view of a top surface of the pallet shown in FIG. 9.

Referring now to FIGS. 9 and 10, illustrated is a second embodiment of a pallet 55 in accordance with the present invention. This embodiment is similar to the first embodiment in that a completed pallet can be formed from only two types of blanks: blank 57 shown in FIG. 11 and blank 59 shown in FIG. 12. Blank 59 comprises a first panel 61 for forming a half-portion of an upper pallet platform 63. Hingedly attached along opposite edges of panel 61 are runner-forming panels 65 for forming a first set of runners 67 extending substantially the distance between opposite edge portions of pallet 55. As in the first embodiment, panels 65 are preferably foldable against each other in an accordion-like manner about hinged edges. The hinged edges may take one or more of the forms described above in connection with the first embodiment. Alternatively, one or more of panels 65 may be provided separate from each other and secured to the other panels in a face-to-face relationship to form each runner 67.

Preferably, each runner-forming panel 65 except panel **65*a* immediately adjacent the platform-forming panel 61 is provided with a cut-out 69 which, when panels 65 are folded against each other in an accordion-like manner form slots for receiving respective cross-runners 71 formed by blank 57. Each runner-forming panel 65 is further provided with cut-outs 72 which, when the respective panels are folded against each other, form fork-receiving slots 73**.

Panel **65*a* is preferably hingedly connected to platform-forming panel 61 along a simple score line, rather than a hinge line formed by one of the other above-mentioned hinging techniques (which include at least partial cuts through the material). A fold along a simple score line advantageously provides smooth transition edge between platform 63 and outer panel 65*a* of each runner 67 extending along opposite edge portions of platform 63**. This creates a pallet with a more attractive appearance suitable for display purposes such as in warehouse-type grocery stores and other retail outlets.

The appearance of pallet 55 is further enhanced by omitting in panel **65*a* the cut-out 69 provided in the other panels 65. In this way, panel 65*a* provides a smooth uninterrupted surface covering the cross-runner-receiving slots provided in runners 67, as well as the end surfaces of cross-runners 71 secured in these slots. Furthermore, panel 65*a*, covering the opposite end surfaces of each cross-runner 71, provides an additional surface for securing each cross-runner 71 to the runner/platform structure formed by blank 59**.

Similar to the first embodiment, to form a completed pallet 55 of the second embodiment, two folded blanks 59 are positioned adjacent to each other in a mirror-image relation. So combined, the two panels 65 seen on the right side of panel 61 in FIG. 12 combine with two panels 65 provided on an identical blank 59 to form a central one of runners 67. As seen in FIG. 10, central runner 67 extends up to the surface of platform 63 and provide an elongated (linear) continuation surface 75 thereof.

Blank 57 preferably comprises a number of cross-runner forming panels 77 attached to each other along respective hinge-lines. The hinge lines can take any one of the forms discussed in connection with the first embodiment. Unlike the first embodiment, cross-runner forming blank 57 forms a single runner only and does not include panels which contribute layers to platform 63. Each panel 77 has provided therein cut-outs 79 mating across hinge lines with identical cutouts 79 provided in an adjacent panel 77 to form a slot for receiving the central one of runners 67 formed from two combined blanks 59. Also, opposite edge portions of each panel 77 have provided therein shoulder-like recesses 81 mating in a mirror-like manner with corresponding recesses 81 provided in an adjacent panel 77 for accommodating the two runners 67 which constitute opposite edge-runners of pallet 55.

Figure 11:
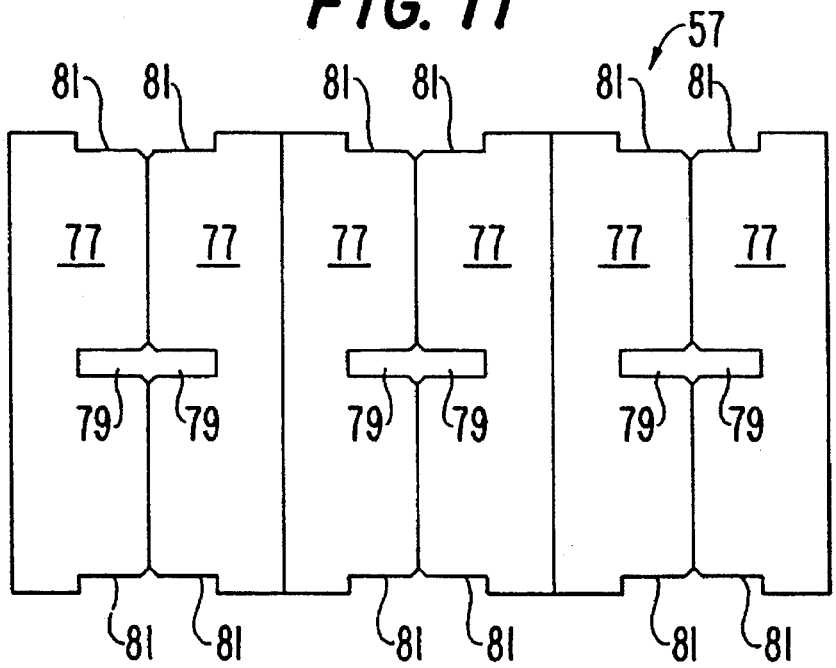
FIG. 11 is a plan view of a blank used to form cross-runners in the pallet of FIGS. 9 and 10.
Figure 12:
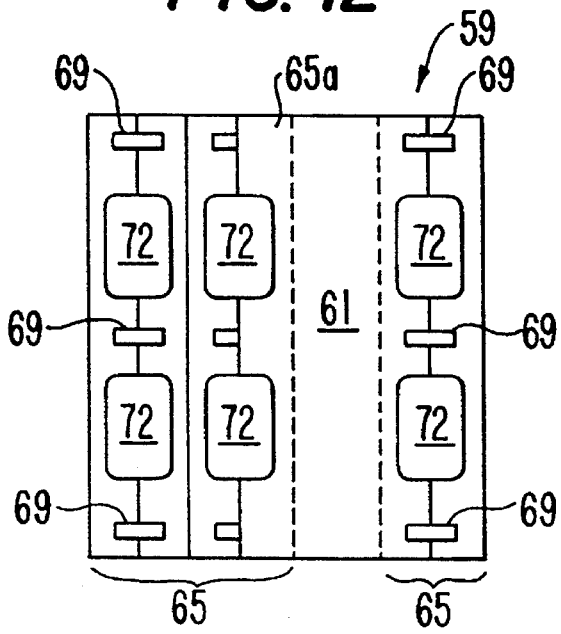
FIG. 12 is a plan view of a blank used to form a platform surface and depending runners in the pallet of FIGS. 9 and 10.

Panels 77 need not be provided in the form of a single integral blank as shown in FIG. 11. As an alternative, for example, pairs of adjacent panels could be provided integrally, separate from other pairs, or each panel 77 could be provided entirely separate from each other. Such a design would enjoy substantially the strength and stability advantages of an integral construction, but may be somewhat more difficult to assemble due to the lack of a hinged connection between adjacent panels 77.

In the illustrated second embodiment, three of each of runners 67 and cross-runners 71 are provided. Obviously, the number of runners may be varied in accordance with the size and load bearing requirements of the pallet. Furthermore, as in the first embodiment, the size and thus the strength of each runner can be easily adjusted by varying the number of runner-forming panels.

Other features described in connection with the first embodiment may be employed with the second embodiment as well. For example, additional appropriate cut-outs could be provided in panels 77 of blank 57 in order to provide the pallet with four-sided fork insertion capability. Also, as in the first embodiment, bottom edge surfaces of runners 67 and 71 comprise exposed corrugation flutes. These edge surfaces may have applied thereto liquid agents for inhibiting migration of moisture/water from a floor surface to the pallet.

Assembly of pallet 55 of the second embodiment is similar to that of the first embodiment. Two blanks 59 are initially folded and placed together to form a platform upper surface 63 and runners 67. This assembly can be held in place through the use of a jig assembly fixture. Then, cross-runners 71 are assembled by folding panels 77 of blanks 57 together in an accordion-like manner. The end portions of each cross-runner 71 are preferably then dipped into adhesive to coat the end portions which will abut with the two panels **65*a* running along opposite edges of platform 63. The upper edge of each cross-runner 71 which abuts against the lower surface of platform 63 may also receive an adhesive in order to enhance pallet rigidity. Also, as with the first embodiment, the surface areas of each runner-forming panel may be coated with adhesive and laminated together to form extremely rigid runners. Next, each runner 71 is slid into engagement with runners 67 and platform 63, in alignment with the slots provided in runners 67**.

Preferably, once the respective pieces of the pallet have been assembled with adhesive applied thereto, the completed assembly is compressed along panels **65*a* of runners 67 to ensure proper glue setting and securement of the cross-runners 71 to outer panels 65*a***.

The present invention has been described in terms of presently preferred embodiments thereof. Other embodiments and modifications within the scope and spirit of the invention will occur to those having ordinary skill in the art.

I claim:

1. A pallet for storing and transporting material thereon, comprising:

two first sheet members which cooperate to form an upper deck top layer and a first set of spaced runners depending from said upper deck and extending in a first direction; and two second sheet members which cooperate to form at least one upper deck lower layer and a second set of spaced runners depending from said upper deck and extending in a second direction perpendicular to said first direction.

2. A pallet according to claim 1, wherein each said first sheet member comprises a main panel forming a portion of the upper deck top layer and a plurality of sets of smaller panels attached to each other and said main panel by hinge means for folding the smaller panels within each set against one another in an accordion-like fashion to form said first set of runners.

3. A pallet according to claim 2, wherein each said second sheet member comprises a plurality of primary panels forming a plurality of upper deck lower layers and a plurality of sets of runner panels attached to each other and to said primary panels by hinge means for folding the runner panels within a given set against each other in an accordion-like fashion to form said second set of spaced runners.

4. A pallet according to claim 3, wherein said primary panel means comprise at least one set of partially overlapped elongated panels, the two second sheet members being secured with respect to each other such that respective primary panels thereof overlap with each other to provide a plurality of upper deck lower layers.

5. A pallet according to claim 1 wherein said first and second sheet members comprise corrugated sheet material and said upper deck top layer formed by said two first sheet members has a corrugation direction perpendicular to a corrugation direction of the upper deck lower layers formed by said two second sheet members.

6. A blank of sheet material for forming a plurality of layers of a pallet platform and a plurality of runners depending therefrom, said blank comprising:

a first platform layer forming panel and a second platform layer forming panel movably connected with said first platform layer panel through a plurality of series of runner-forming panels connected to each other and to the first and second platform layer forming panels along respective hinged edges thereof, whereby when said runner-forming panels within a series are folded against each other in an accordion-like manner, said first and second platform layers at least partially overlap with each other to form multiple platform layers, and said runner-forming panels form a plurality runners depending therefrom.

7. A blank of sheet material according to claim 6, wherein each runner-forming panel is provided with a cut-out portion for forming a receiving slot for an intersecting runner when the runner-forming panels are folded against each other in said accordion-like manner.

8. A blank according to claim 7, wherein said first platform layer has therein a plurality of elongated cut-out portions aligned with the cut-out portions in said runner-forming panels for receiving therein said intersecting runner.

9. A blank according to claim 8, wherein each elongated cut-out portion has adjacent thereto a hingedly attached flap panel for securing to an intersecting runner.

10. A blank according to claim 6, wherein said sheet material is corrugated board material.

11. A set of blanks of sheet material for forming a pallet, said set of blanks comprising a first blank and a second blank, said first blank comprising a platform upper layer-forming panel and a plurality of runner-forming panels hingedly attached to opposite edges of the platform-forming panel, said runner-forming panels including pairs of panels hingedly connected at adjacent edges thereof and a plurality of spaced-apart cut-outs extending across said adjacent edges for forming cross-runner receiving slots when the runner-forming panels are folded together in an accordion-like manner, said second blank comprising a first platform underlayer forming panel and a second platform underlayer forming panel movably connected with said first platform underlayer forming panel through a plurality of series of cross-runner forming panels connected to each other and to the first and second platform underlayer forming panels along respective hinged edges thereof, whereby when said cross-runner forming panels within a series are folded against each other in an accordion-like manner, said first and second platform underlayer forming panels at least partially overlap with each other to form multiple platform layers, and said cross-runner-forming panels form a plurality of cross-runners depending therefrom.

* * * * *